US011358043B2

(12) United States Patent
Kalfa

(10) Patent No.: US 11,358,043 B2
(45) Date of Patent: Jun. 14, 2022

(54) SPORT TRAINING BAG

(71) Applicant: Slinger Bag Ltd., Ra'anana (IL)

(72) Inventor: Yonah Kalfa, Ra'anana (IL)

(73) Assignee: Slinger Bag Ltd., Ra'anana (IL)

( * ) Notice: Subject to any disclaimer, the term of this patent is extended or adjusted under 35 U.S.C. 154(b) by 72 days.

(21) Appl. No.: 16/885,017

(22) Filed: May 27, 2020

(65) Prior Publication Data

US 2020/0360792 A1 Nov. 19, 2020

Related U.S. Application Data

(63) Continuation-in-part of application No. PCT/IL2018/050927, filed on Aug. 22, 2018.

(30) Foreign Application Priority Data

Nov. 29, 2017 (IL) ..... 255995

(51) Int. Cl.
*A63B 69/40* (2006.01)
*A45C 5/14* (2006.01)
(Continued)

(52) U.S. Cl.
CPC ..... *A63B 69/406* (2013.01); *A45C 5/14* (2013.01); *A45C 13/262* (2013.01); *A45C 15/00* (2013.01); *A45F 3/14* (2013.01); *A63B 60/58* (2015.10); *A45C 2013/267* (2013.01); *A45F 2003/003* (2013.01); *A63B 2102/02* (2015.10); *A63B 2225/50* (2013.01)

(58) Field of Classification Search
CPC ... A63B 69/406; A63B 60/58; A63B 2102/02; A63B 2225/50; A45C 5/14; A45C 13/262; A45C 15/00; A45C 2013/267; A45F 3/14; A45F 2003/003
USPC ..... 124/78; 473/422, 451; 224/576
See application file for complete search history.

(56) References Cited

U.S. PATENT DOCUMENTS 3,844,267 A * 10/1974 Mohr ..... A63B 69/406 124/78
4,086,903 A * 5/1978 Scott ..... A63B 69/406 124/78
(Continued)

FOREIGN PATENT DOCUMENTS

CN 2412609 Y 1/2001
CN 200945350 Y 9/2007
(Continued)

OTHER PUBLICATIONS

Office Action for Chinese Application No. 201880076477.4, dated Apr. 23, 2021.
(Continued)

*Primary Examiner* — Alexander R Niconovich
(74) *Attorney, Agent, or Firm* — Klarquist Sparkman, LLP

(57) ABSTRACT

A carrying bag comprises a ball hopper compartment, an automatic launching apparatus configured to launch balls to a distance from the bag, a ball sorting apparatus for loading balls to the launching apparatus from a bottom side opening of the ball hopper compartment, which in one embodiment is configured with an anti-jamming function, and a four contact point base with the ground to provide stability both when the bag is stationary as well as while balls are being launched.

20 Claims, 12 Drawing Sheets

(51) Int. Cl.

| | |
|---|---|
| ***A45C 13/26*** | (2006.01) |
| ***A45F 3/14*** | (2006.01) |
| ***A63B 60/58*** | (2015.01) |
| ***A45C 15/00*** | (2006.01) |
| *A63B 102/02* | (2015.01) |
| *A45F 3/00* | (2006.01) |

(56) References Cited

U.S. PATENT DOCUMENTS

| | | | | |
|---|---|---|---|---|
| 6,176,230 | B1 * | 1/2001 | Thompson | A01K 15/025 124/16 |
| 6,386,414 | B1 * | 5/2002 | Kilduff | A45C 15/00 383/102 |
| 6,604,767 | B1 * | 8/2003 | Daniels | A63B 47/02 294/19.2 |
| 9,039,547 | B2 | 5/2015 | Yeager | |
| 9,339,698 | B2 | 5/2016 | Zhang et al. | |
| 10,556,155 | B2 * | 2/2020 | Nelson | A63B 47/001 |
| 2005/0115548 | A1 * | 6/2005 | Wilson | F41B 11/62 124/56 |
| 2007/0017948 | A1 * | 1/2007 | Smithson | A63B 47/021 224/663 |
| 2012/0104060 | A1 * | 5/2012 | Swenson | A45F 5/00 224/257 |
| 2012/0273540 | A1 * | 11/2012 | Preston | A45F 3/04 224/576 |
| 2013/0104870 | A1 * | 5/2013 | Rizzo | A63B 69/38 124/78 |
| 2014/0038751 | A1 * | 2/2014 | Yeager | A63B 69/40 473/431 |
| 2014/0109887 | A1 * | 4/2014 | Edson | A63B 47/04 124/78 |
| 2014/0374456 | A1 * | 12/2014 | Zhang | A63B 47/00 224/576 |
| 2015/0297972 | A1 | 10/2015 | Vaught et al. | |
| 2016/0144260 | A1 * | 5/2016 | Cohen | A63B 69/40 473/461 |
| 2016/0310817 | A1 * | 10/2016 | Yeager | A63B 69/406 |
| 2017/0266516 | A1 * | 9/2017 | Askenazi | A63B 47/02 |
| 2017/0266530 | A1 * | 9/2017 | Pepe | A63B 43/004 |
| 2021/0260461 | A1 * | 8/2021 | Voloshin | A63B 47/021 |

FOREIGN PATENT DOCUMENTS

| | | | |
|---|---|---|---|
| CN | 204684584 | U | 10/2015 |
| CN | 207221243 | U | 8/2018 |
| JP | S58-166369 | | 11/1983 |
| JP | S60-53167 | | 3/1985 |
| JP | H01-152675 | | 10/1989 |
| JP | 3046441 | U | 3/1998 |
| JP | H10-234924 | | 9/1998 |
| JP | 2014-140573 | | 8/2014 |

OTHER PUBLICATIONS

International Preliminary Report on Patentability for PCT/IL2018/050927 (dated Dec. 25, 2019).

International Search Report and Written Opinion for PCT/IL2018/050927 (dated Nov. 7, 2018).

Office Action for Japanese Patent Application No. 2020-547478, dated Dec. 7, 2021.

Extended European Search Report for European Application No. 18884438.5, dated Jul. 26, 2021.

* cited by examiner

SPORT TRAINING BAG

CROSS REFERENCE TO RELATED APPLICATIONS

This is a U.S. bypass continuation-in-part application of international application PCT/IL2018/050927, filed on Aug. 22, 2018 and entitled "TENNIS TRAINING BAG", which claims priority from IL 255995, filed on Nov. 29, 2017 and entitled "TENNIS TRAINING BAG," which are all incorporated herein by reference.

FIELD

The present invention relates to the field of sports practice accessories. More particularly, the invention relates to a portable carrying bag for sport training equipment, specifically a ball launcher.

BACKGROUND

When transporting equipment for a sports practice, e.g., for a tennis practice, it is inconvenient to carry each of the items (e.g., one or more rackets and a plurality of tennis balls) of equipment separately. Tennis bags and backpacks are typically used for carrying rackets and tennis balls. Other bags include, among others, baseball bags and golf bags.

An important aspect of a sports training session is the preparation of the trainee for a match against an opponent. In order to simulate a match, automatic ball launching devices allow a trainee to be challenged to respond to balls being automatically launched in a manner that simulates plays of an opponent. Several commercially available automatic ball launching devices exist, however they are commonly bulky and heavy, and are therefore inconvenient to transport from one place to another (e.g., from home to the training field/court).

US Patent Application No. 2016/0310817A1 discloses a sports simulation robot that is small and light enough to be easily stored and transported, although in order to do so it must be dismantled and folded. Obviously a previously stored and transported simulation robot according to US2016/0310817A1 would require assembly in order to use it.

It would be advantageous to have a light-weight sports training bag that contains a ready-to-use, small and light-weight automatic ball launching device. It is an object of the present invention to provide such a sports training bag.

It is another object of the present invention to provide a sports training bag with an embedded sports simulation robot.

Other objects and advantages of this invention will become apparent as the description proceeds.

SUMMARY

The present invention relates to a carrying bag for sports equipment, comprising compartments suitable to accommodate sports equipment; and an automatic launching apparatus configured to launch sports balls to a distance from the bag.

According to an embodiment of the present invention, the carrying bag comprises:

a. a tennis ball hopper compartment, suitable to accommodate a plurality of tennis balls, with an opening in the bottom side of the compartment;

b. a tennis racket compartment, suitable to accommodate one or more tennis rackets, in a removable secondary inner tennis bag;

c. an automatic launching apparatus compartment accommodating the automatic launching apparatus;

d. a ball sorting apparatus for loading balls to the loading side of the automatic launching apparatus in a controlled manner;

e. a control panel, suitable to control the behavior of the automatic launching apparatus and of the ball sorting apparatus; and f. shoulder straps allowing the carrying bag to be carried;

wherein the automatic launching apparatus comprises a loading section and an ejection section; and wherein a tennis ball is automatically delivered by the ball sorting apparatus from the ball hopper compartment to the loading section of the automatic launching apparatus and is automatically launched therefrom through the ejection section to a distance.

According to another embodiment of the present invention, the automatic launching apparatus comprises an electrically rotatable fly wheel. According to still another embodiment of the invention, the carrying bag further comprises a launch angle mechanism configured to determine the direction at which balls are launched from the automatic launching apparatus. According to yet another embodiment of the present invention, the launch angle mechanism is a deflection member electronically controlled by the control panel.

According to another embodiment of the invention, the carrying bag further comprises one or more sensors configured to detect control commands given from afar. According to yet another embodiment of the present invention, the carrying bag further comprises a wireless communication module configured to wirelessly communicate with an electronic computing device.

According to another embodiment of the present invention, the carrying bag further comprises wheels on opposite sides of the bag and an extendable handle for carting the carrying bag. According to another embodiment of the present invention, the carrying bag further comprises a retractable "trolley" type handle, allowing the bag to be wheeled.

According to still another embodiment of the invention, the distance between the front ejecting section of the launching apparatus and the axle of the bag's wheels is selected so as to allow the bag to withstand launching forces, taking in account the horizontal component of said launching force and the weight of the bag.

According to an embodiment of the present invention, the carrying bag comprises an external hard shell chassis structure; an internal structure that is attached to the outer structure, and which holds the launching and ball sorting apparatuses in place, divides between the compartments and prevents the bag from collapsing; and an outer fabric that houses all of the compartments, protects the internals from ingressions, and provides ergonomic means for handling the bag. According to another embodiment of the invention, the carrying bag further comprises fabric straps for carrying and handling the bag.

According to yet another embodiment of the invention, the carrying bag further comprises a four contact point base with the ground.

DETAILED DESCRIPTION

A sport carrying bag comprising a plurality of compartments to store in each of which equipment or products needed to undergo training with respect to a desired ball related sport activity, and automatic launching apparatus capable of delivering one or more balls at a desired speed and angle to a desired distance is surprisingly efficient, compact and convenient.

Although the following description relates to apparatus for the launching of tennis balls, the sport carrying bag is similarly applicable to the launching of other types of balls, such as pickleballs, paddle balls and soft tennis balls.

Reference will now be made to an embodiment of the present invention, examples of which are illustrated in the accompanying figures for purposes of illustration only. One skilled in the art will readily recognize from the following description that alternative embodiments of the structures and methods illustrated herein may be employed, mulatis mutandis, without departing from the principles of the claimed invention.

Figure 1A:
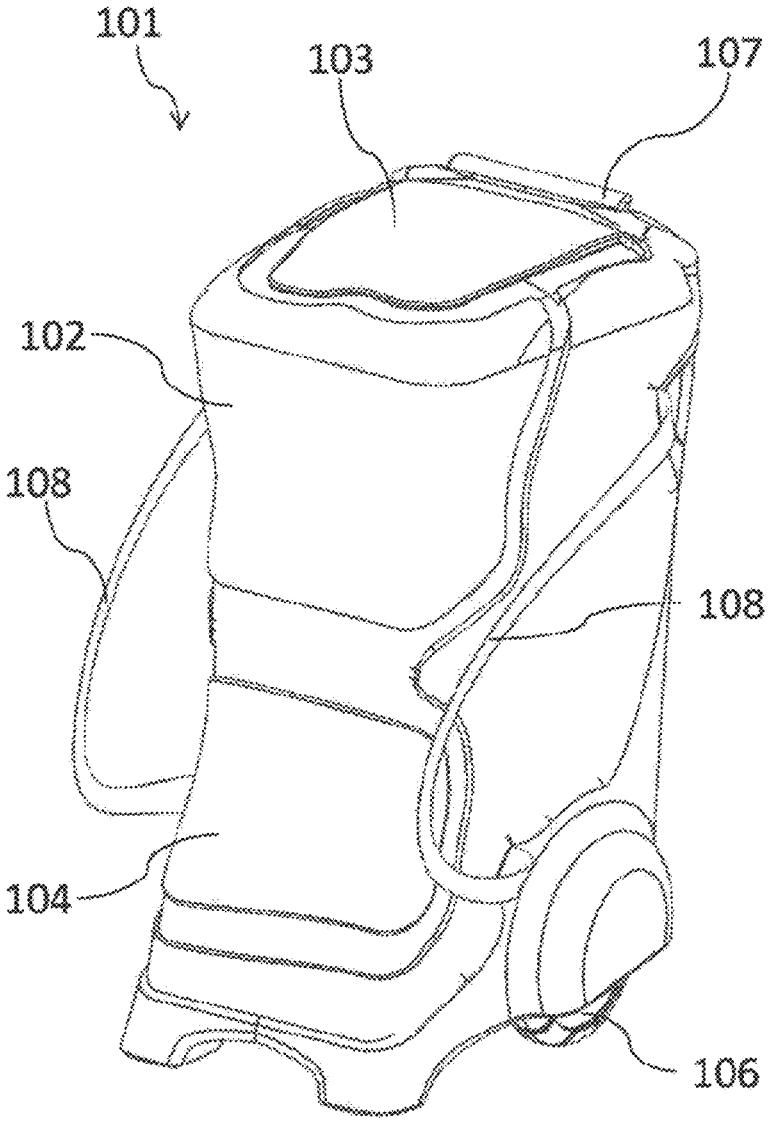
FIGS. 1A and 1B each show different perspective views of a tennis equipment carrying bag, according to an embodiment.
Figure 1B:
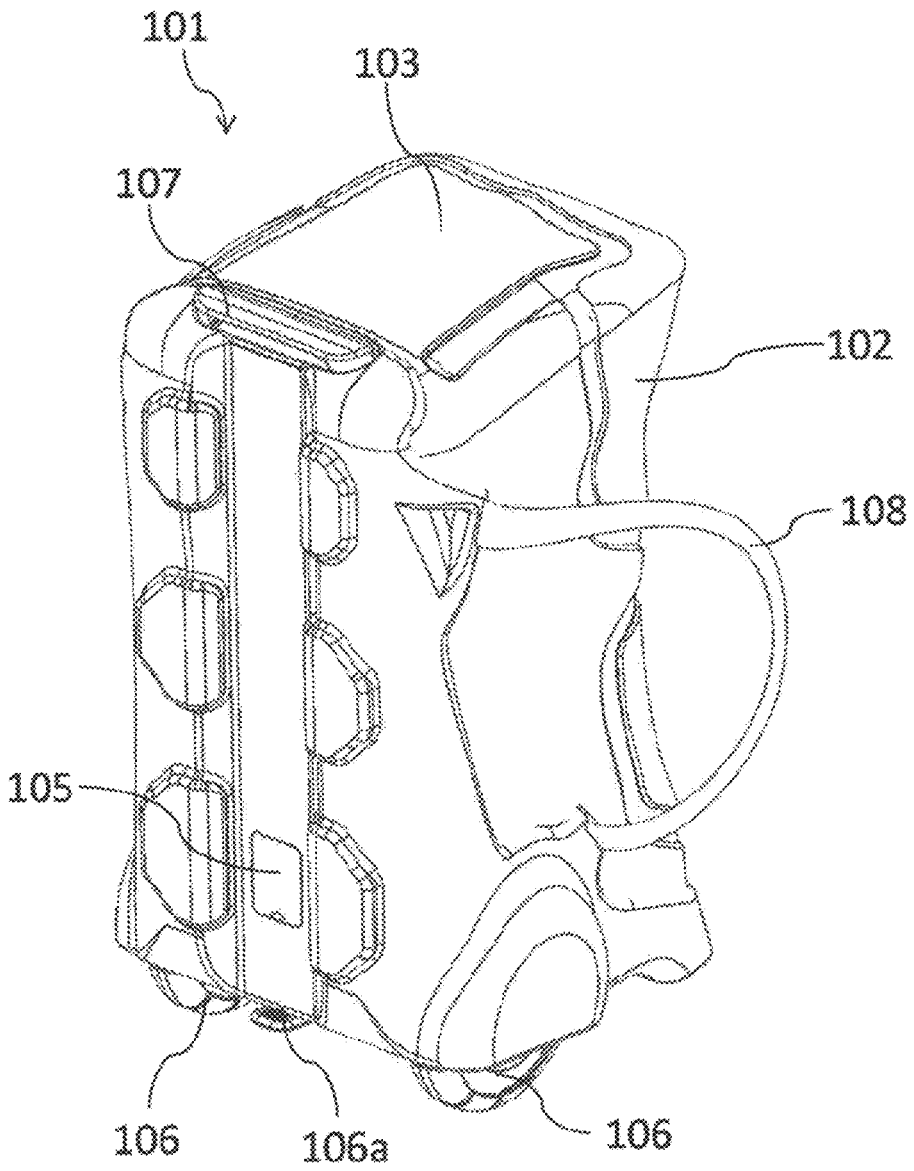

FIGS. 1A and 1B show different perspective views of a tennis equipment carrying bag 101 according to one embodiment. The exterior of carrying bag 101 comprises a cover 102 of a ball compartment, a cover 103 of a tennis racket compartment, a cover 104 of a launching compartment, a cover 105 of an electronic panel, wheels 106 and wheels-brake 106*a*, a handle 107 and shoulder straps 108.

Handle 7 may be a "trolley" type handle which is connected to telescopic arms, allowing handle 107 to be shifted back and forth from its initial unextended position (as shown in the FIGS.) to an extended position in which the handle is positioned further away from wheels 106 than in the initial unextended position. Carrying bag 101 may be wheeled using handle 107 in a manner similar to suitcases and luggage, in addition to being able to be carried by shoulder straps 108 or any other handle that may be added, e.g., between covers 102 and 103.

Figure 2:
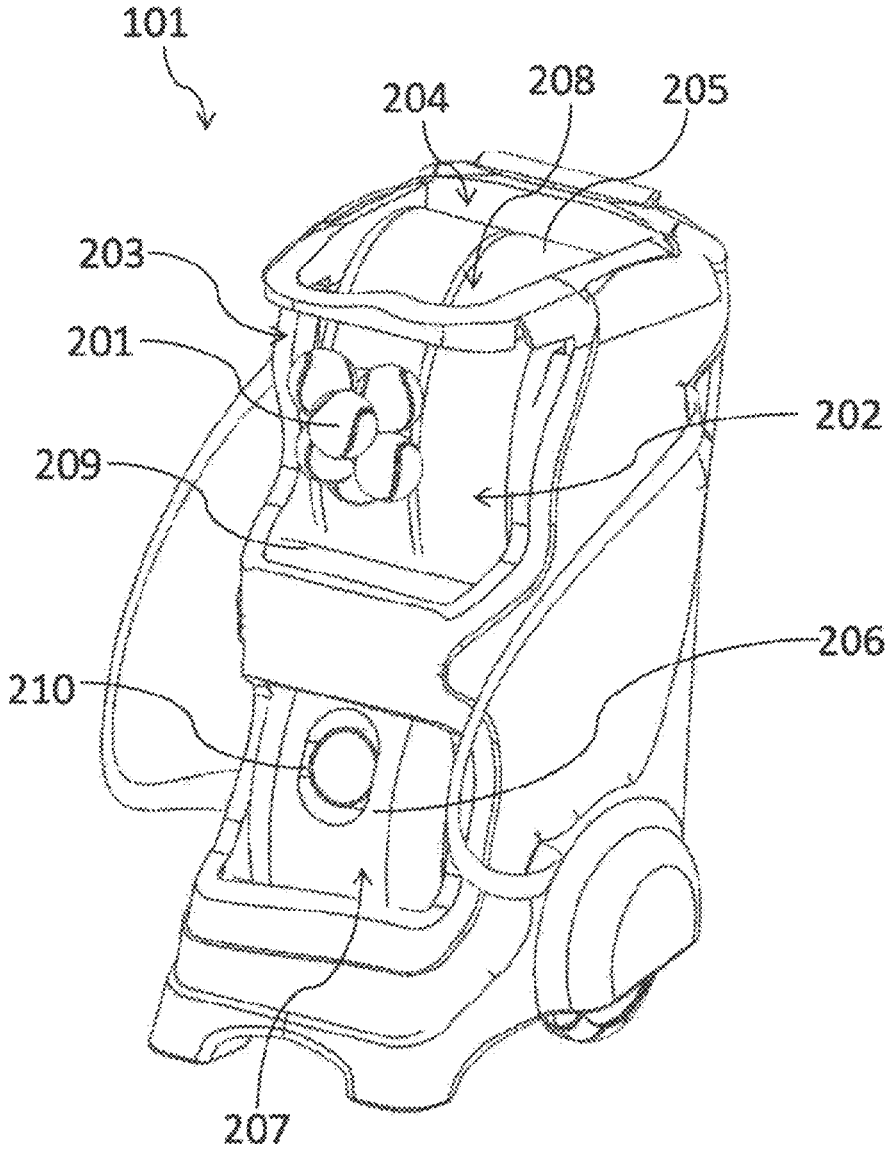
FIG. 2 shows a perspective view of the carrying bag of FIG. 1A in which covers of various compartments are removed.

FIG. 2 shows a perspective view of the tennis equipment carrying bag 101 of FIGS. 1A and 1B in which covers 102, 103, 104 and 105 are removed, according to an embodiment of the invention. A plurality of tennis balls 201 are received within tennis ball hopper compartment 202. Tennis balls 201 may be inserted and withdrawn from compartment 202 via opening 203 or 204 in bag 101. Similarly, a plurality of tennis rackets 205 are partially shown inside a removable secondary inner tennis bag (provided inside tennis racket compartment 208) and may be inserted thereto and withdrawn therefrom via opening 204 in bag 101. Carrying bag 101 further comprises a four contact point base with the ground, providing stability both when the bag is stationary as well as while balls are being launched.

Figure 3:
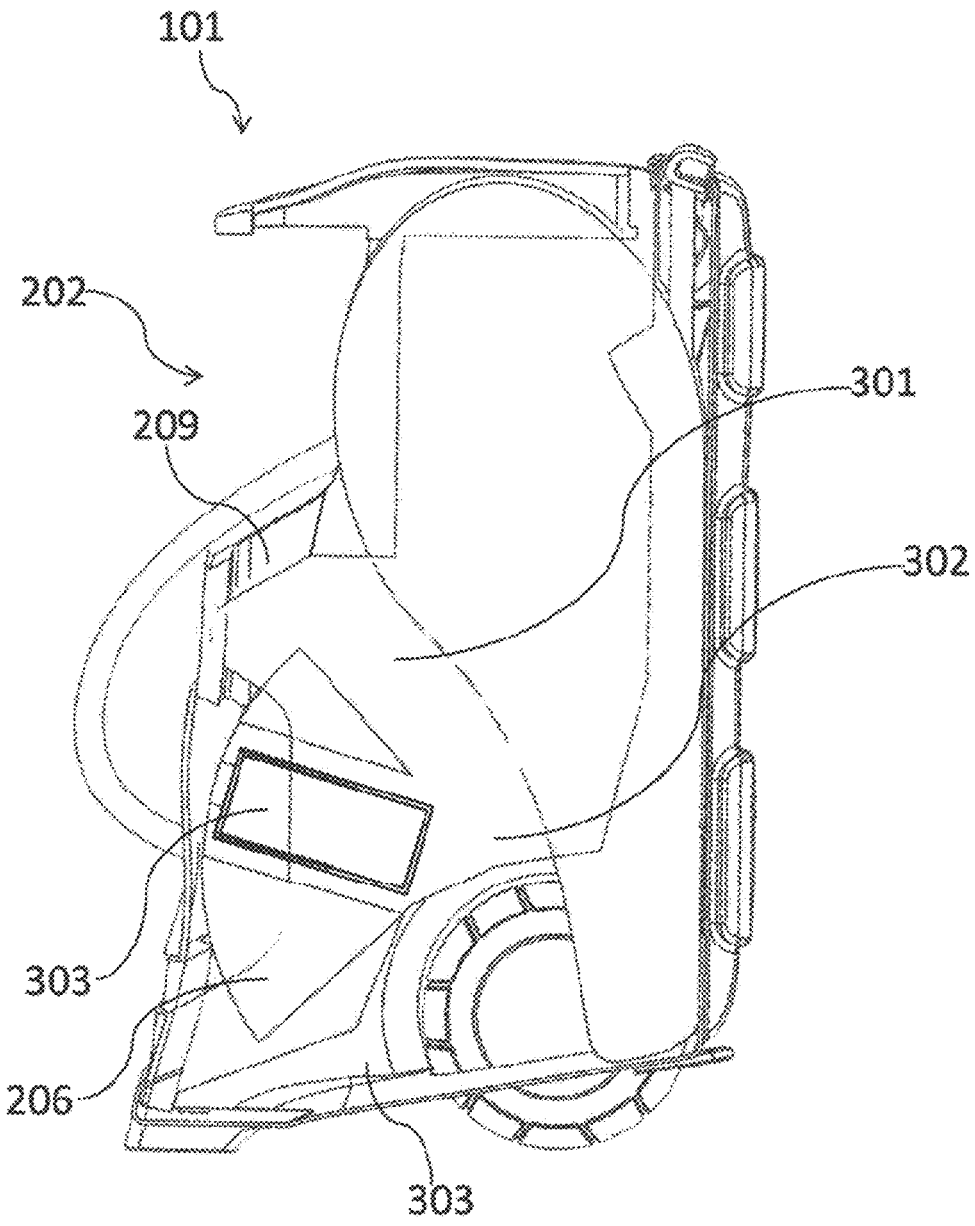
FIG. 3 schematically illustrates a cutaway side view of the tennis equipment carrying bag of FIGS. 1A and 1B, according to an embodiment.

An automatic launching apparatus 206 is shown inside launcher compartment 207. FIG. 3 schematically illustrates a cutaway side view of tennis equipment carrying bag 101 according to an embodiment of the invention. Opening 209 in the bottom side of tennis ball hopper compartment 202 allows balls to pass through passage 301 to a loading section 302 at the rear side of launching apparatus 206. According to an embodiment of the present invention, a plurality of balls may simultaneously pass through opening 209 and passage 301 and be present at loading section 302, whereas the diameter of the pipe-shaped barrel 303 of the automatic launching apparatus 206 allows only one ball to enter the barrel. Launching apparatus 206, which when operated, causes a single tennis ball that is located at loading section 302 to be forced out of barrel 303.

According to an embodiment of the preset invention, in order to allow the above-detailed features of carrying bag 101, bag 101 comprises a hard outer plastic shell exoskeleton, made of fiber reinforced thermoplastic, capable of supporting bag 101's content as well as providing the bag's rigidness. Secondly the internal mechanisms are held in place by an internal structure that is fastened to bag 101's chassis (outer shell). The internal structure holds the internal elements in place (e.g., launching apparatus 206), and functions as a compartment divider, by segmenting bag 101's volume. According to an embodiment of the invention, since the overall mass needs to be manageable by the end user (i.e., low-weight), the structural materials will be reinforced polymers instead of metals.

According to an embodiment of the present invention, the direction at which balls are ejected from barrel 303 is determined by the horizontal orientation of carrying bag 101, and by a mechanical launch angle mechanism. According to another embodiment of the invention, an electronically controlled deflection member (numeral 210 in FIG. 2) is provided adjacent to the front ejecting side of barrel 303. When activated, balls that are ejected from the front side of barrel 303 engage deflection member 210 and are redirected thereby. In this embodiment control panel 400 (FIG. 4) is adapted to control the activation and orientation of deflection member 210, thereby allowing balls to be aimed in various directions.

According to another embodiment of the present invention, in order to prevent balls from being jammed while being fed to the launching apparatus, an electrically rotatable ball sorting apparatus is provided for controlled loading of balls, wherein a user may determine the rate or other condition (e.g., upon receipt of an explicit command) at which balls will be delivered by the ball sorting apparatus to the loading section of the launching apparatus.

Figure 4:
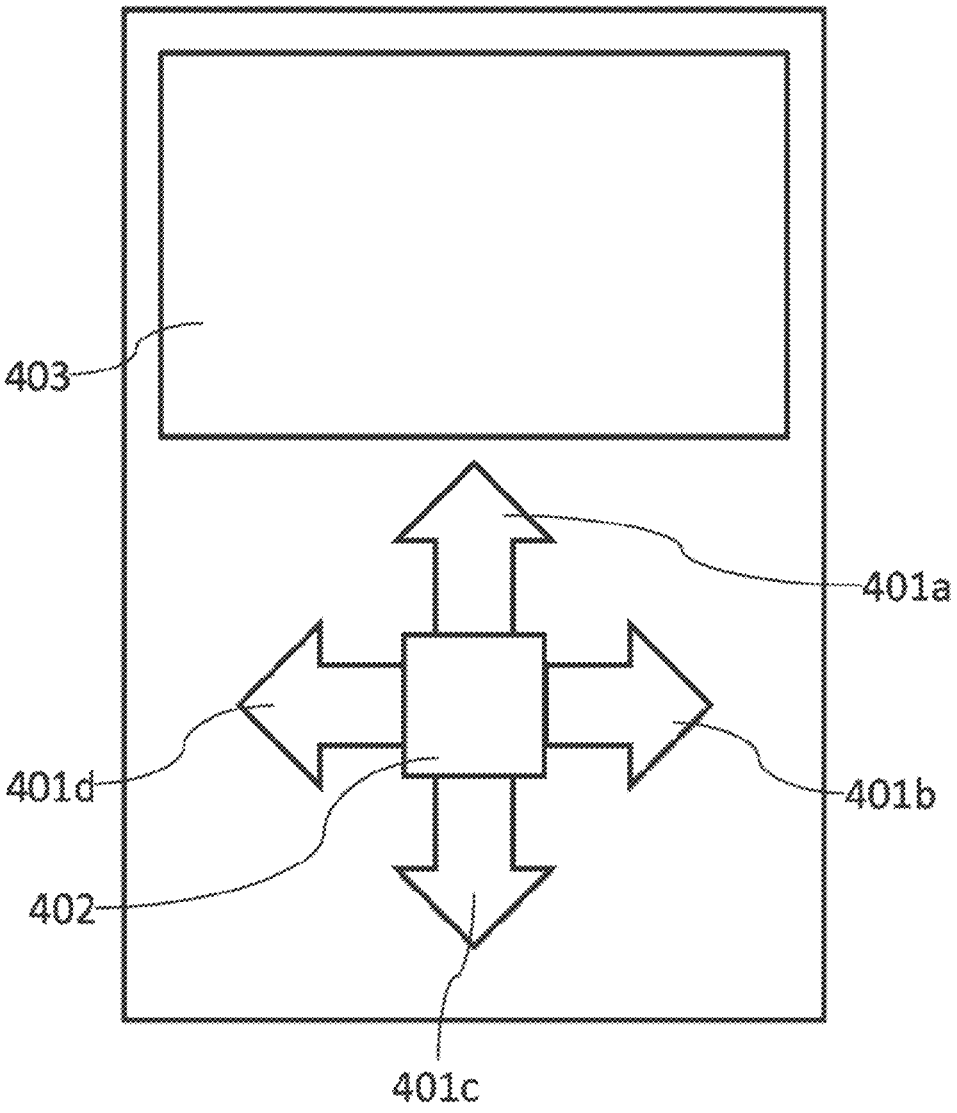
FIG. 4 schematically illustrates an electronic control panel, according to an embodiment.

FIG. 4 schematically illustrates an electronic control panel 400 according to an embodiment of the invention. Control panel 400 is located behind the electronic panel cover 105, shown in FIG. 1B, connected to a power source (numeral 303 in FIG. 3). Using arrow buttons 401*a-d* and selection button 402, a user may control the behavior of automatic launching apparatus 206 according to what is presented on screen 403. For instance, a user may set an electrically controlled ball sorting apparatus to load a ball to the launching apparatus 206 once every 3 seconds or once every other fixed or unfixed time interval, and the velocity at which each ball is launched.

Figure 5:
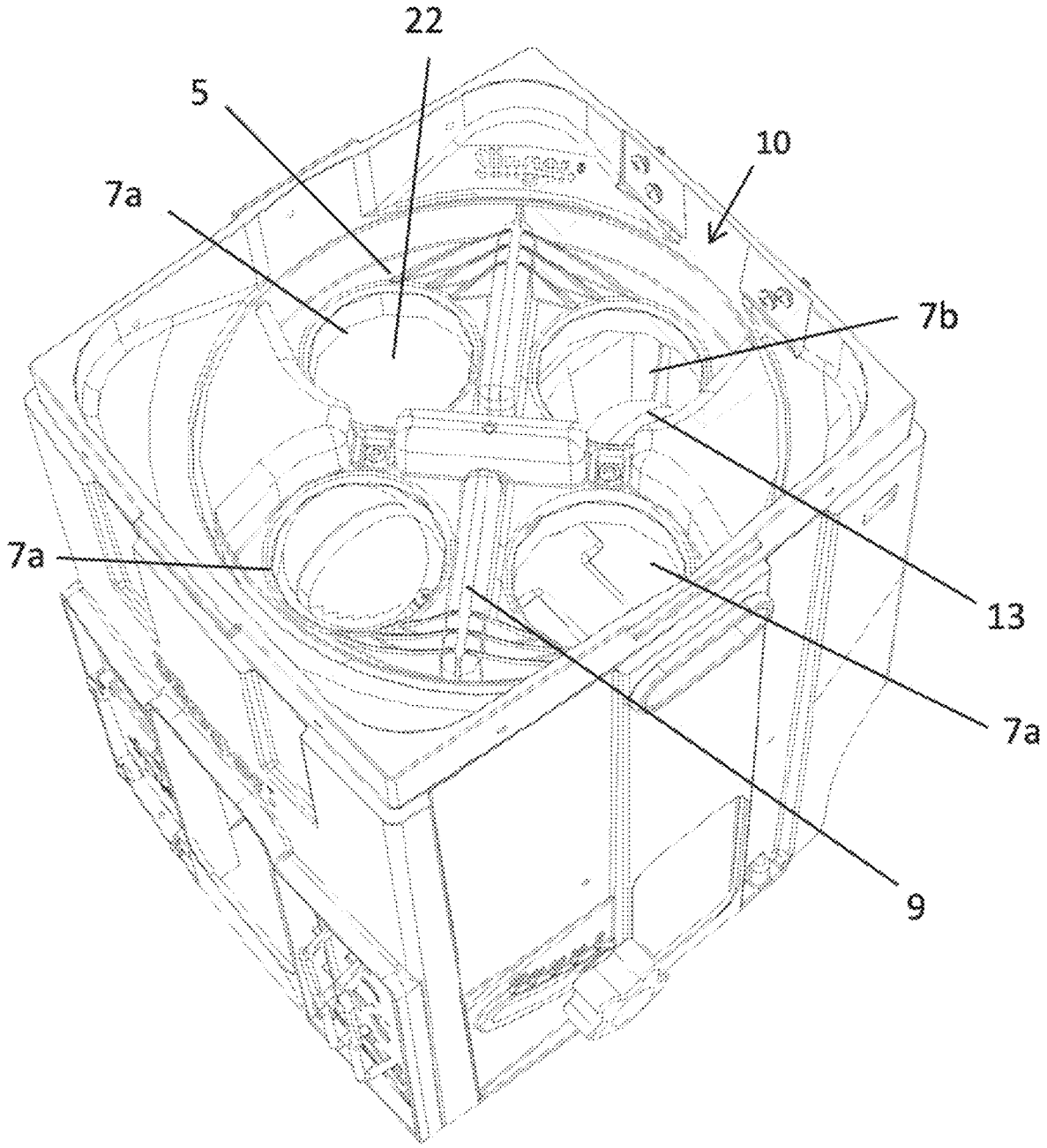
FIG. 5 is a perspective view from the top of ball sorting apparatus.
Figure 6:
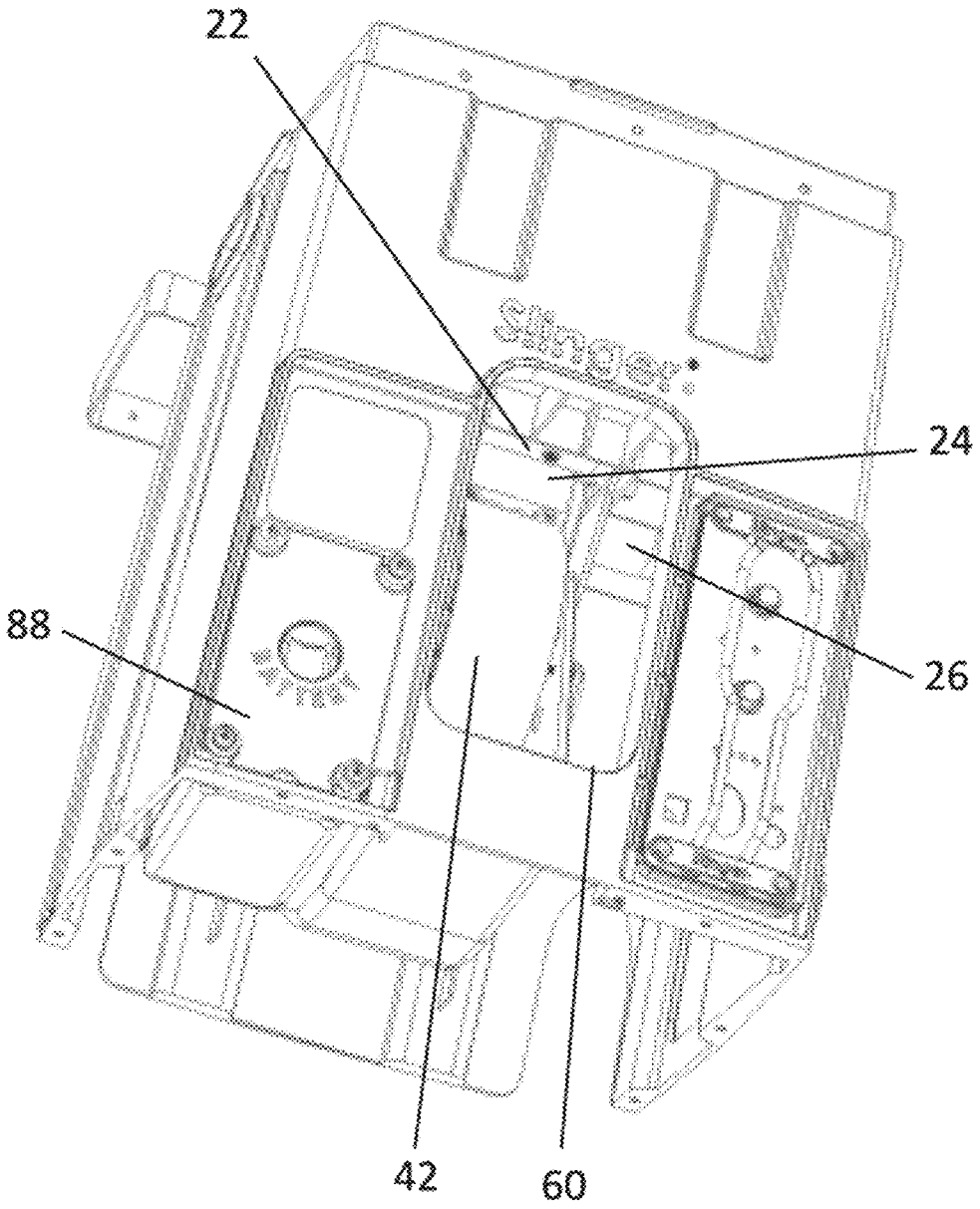
FIG. 6 is a perspective from the front and bottom of an inner shell of a carrying bag according to another embodiment.
Figure 7:
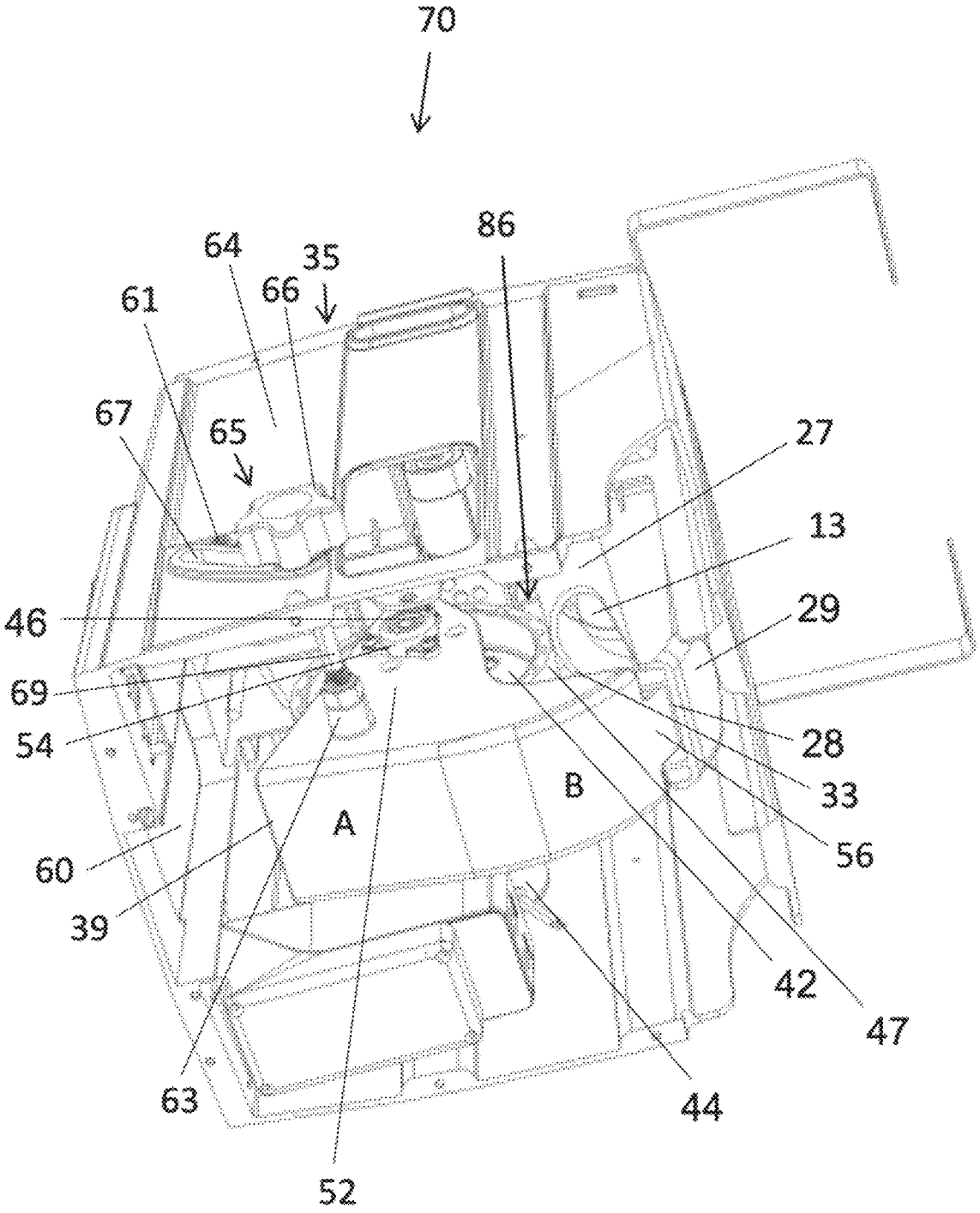
FIG. 7 is a perspective view from the side and bottom of the carrying bag of FIG. 6, shown without the outer shell, showing a launch angle adjusting mechanism.

As shown in FIG. 5, ball sorting apparatus 10 comprises disc 5 that is rotatable about a vertical axis and that is located above horizontal mounting plate 22, which is also seen in FIG. 6. Disc 5 is configured with a plurality of circumferentially spaced ball-receiving regions 7, e.g., four regions, each of which is separated from an adjacent region by a partition 9 that slightly protrudes upwardly from the surface of disc 5. Most of the ball-receiving regions 7*a* may be a region that is recessed from the surface of disc 5, with the exception of a single region 7*b* which is a through-hole region. When disc 5 rotates, a ball 13 received in through-hole region 7*b* generally contacts mounting plate 22; however, at one angular position of disc 5, through-hole region 7*b* coincides with a chute, and the ball 13 received in through-hole region 7*b* ceases to be contacted by mounting plate 22 and consequently gravitates into chute 27 (FIG. 7). Chute 27 in turn directs ball 13 to the loading section 33 of automatic launching apparatus 86.

Disc 5 may be driven by the vertical shaft of a gearbox 24 connected to motor 26, which may be bi-directional. Gearbox 24 and motor 26 are shown in FIG. 6 to be fixed to mounting plate 22. Gearbox 24 allows disc to rotate at a sufficiently slow speed of no greater than approximately 6.7 rpm that will ensure that a ball will be received in, and not overshoot, chute 27. The speed of motor 26 may be adjusted so that the feed rate of a ball to the launching apparatus is controllable to a predetermined rate ranging from 2.5-8 seconds. A carrying bag 70 according to another embodiment which is configured with automatic launching apparatus 86 is illustrated in FIGS. 6-13.

Carrying bag 70 may be wheeled using an extendable handle 72 or may be carried by shoulder straps 74, as described with respect to carrying bag 101. Carrying bag 70 is configured with an outer shell 76, generally a water repellant plastic material, which is compartmentalized, and an inner shell 35 spaced from outer shell 76 and enclosing the ball sorting apparatus 10, launching apparatus 86 and control system 90. Inner shell 35 is generally made of a lightweight metal such as aluminum, but also may be made of a plastic material.

Figure 9:
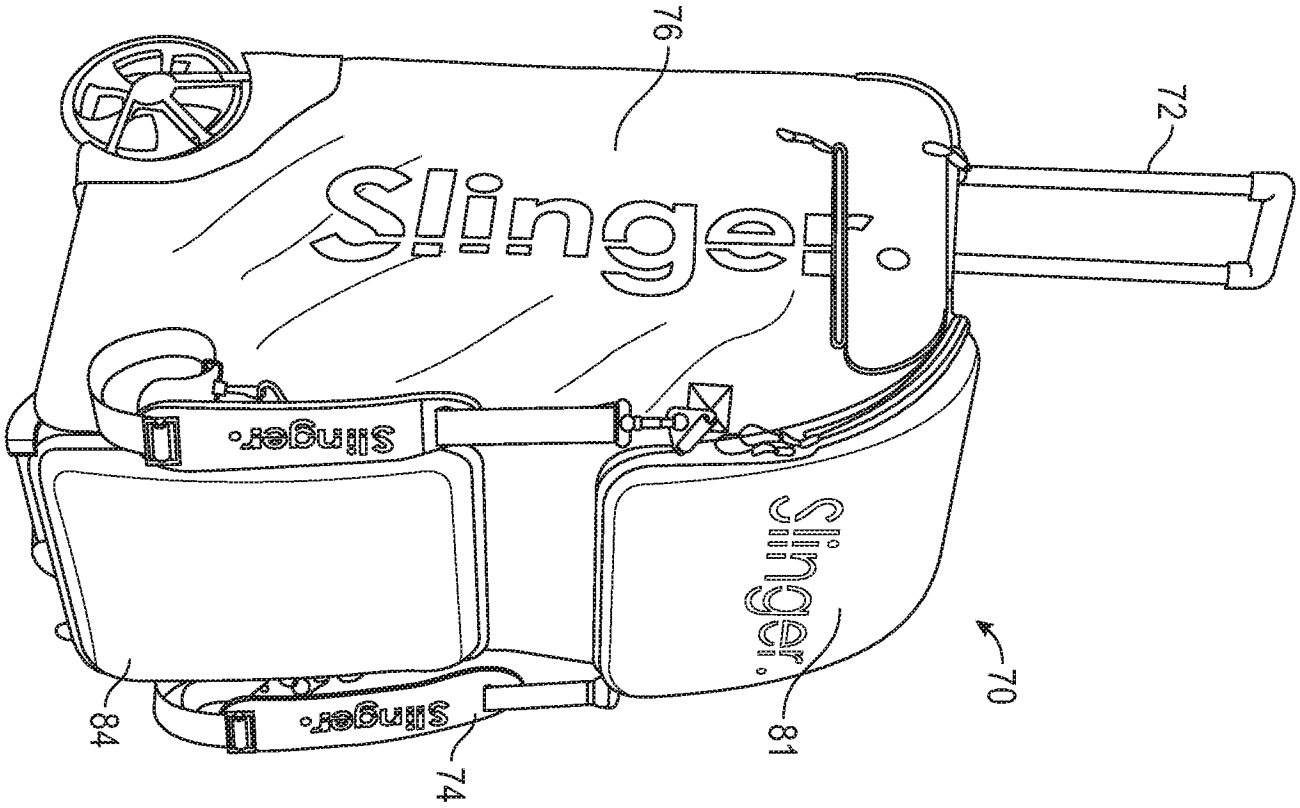
FIG. 9 is a perspective view of the carrying bag of FIG. 6 together with the outer shell, showing the ball hopper compartment in a closed condition.
Figure 10:
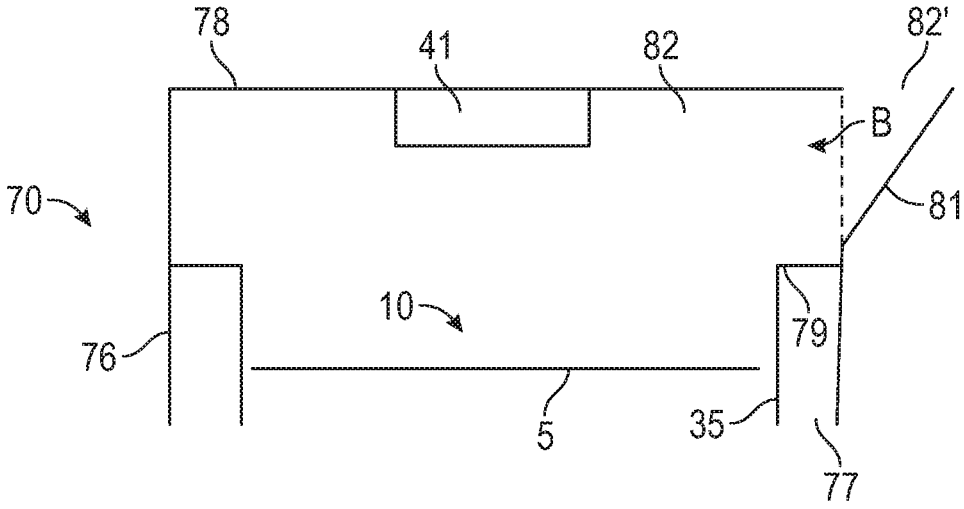
FIG. 10 is a schematic side view of the carrying bag of FIG. 9, showing the relation between the ball hopper compartment and the ball sorting apparatus while the ball hopper compartment in an opened condition.
Figure 11:
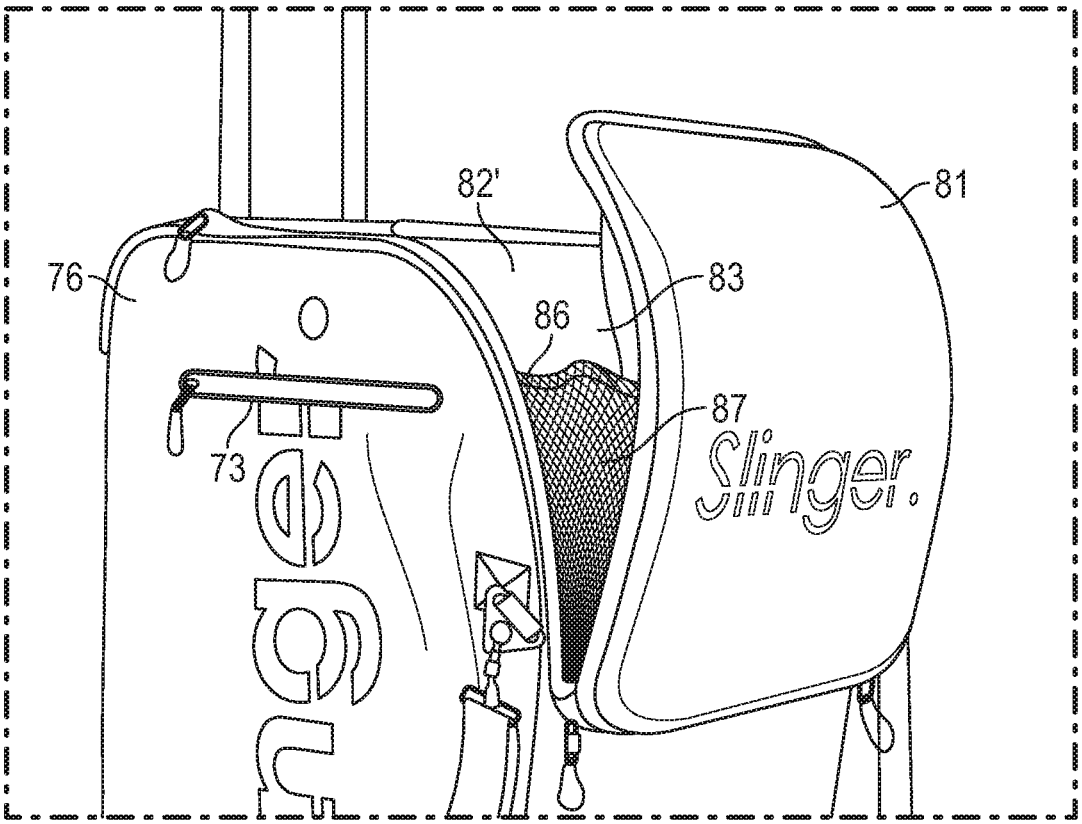
FIG. 11 is a perspective view of the carrying bag of FIG. 9, showing the ball hopper compartment in an opened condition.

An integral and expandable hopper compartment 82 provided with carrying bag 70 is shown in FIGS. 9-11. Hopper compartment 82 in which a plurality of balls are stored prior to being launched is located above, and in communication with, ball sorting apparatus 10. The hopper compartment cover 81, for example made of hard plastic, e.g., 500D nylon material, or of padding material similar to the material of the entire outer shell 76, is shown in FIG. 9 to be in a closed conditioned after being secured to the outer shell, such as by a zipper.

Hopper compartment cover 81 is located above launching compartment cover 84 which covers the opening through which balls are launched. In this closed condition, a first number of balls, e.g., 100 balls, is able to be stored in hopper compartment 82, while being supported by platform 79 extending between opposed sidewalls 77 of outer shell 76. The balls may fall from platform 79 onto rotating disc 5 of ball sorting apparatus 10, which facilitates individual feeding of balls to the launching apparatus. A sidewall 77 may be partially defined by inner shell 35.

When hopper compartment cover 81 is set to the opened condition shown in FIG. 11, an expanded hopper compartment 82' is produced whose volume includes, and is greater than, the volume of unexpanded hopper compartment 82, being able to hold an increased second number of balls, e.g., 150 balls. Balls are able to be gravitationally delivered from a region of expanded hopper compartment 82' near hopper compartment cover 81 towards disc 5, as indicated by arrow B. Two laterally separated and foldable net partitions 86 are tensioned to block the formed opening 83 between a piece of outer shell 76 and hopper compartment cover 81 and to thereby prevent the outward discharge of the stored balls through opening 83. A thickened fabric piece 87 may interconnect two adjacent net sections of each net partitions 86, providing added strength to the net partition that is sufficient to resist outward discharge of the second number of balls. With this expandable hopper compartment arrangement, the same number of balls that were able to be fed heretofore only by sophisticated, heavy and expensive apparatus is feedable by the light and portable carrying bag of the present invention.

A mobile device compartment 41 may be attached to a central portion of the top 78 of outer shell 76. A tennis racket compartment 73 may be provided in a side section of outer shell 76.

As shown in FIG. 7, the automatic launching apparatus 86 of carrying bag 70 may comprise an electrically rotatable fly wheel 42, which is rotated generally by means of a motor 44 whose horizontal drive shaft 46 is coaxial and in driving engagement with fly wheel 42. Upon operation of motor 44, fly wheel 42 rotates and its cylindrical periphery 47, shown more clearly in FIG. 8, which may be uninterrupted, frictionally contacts a single tennis ball that has been introduced into loading section 33, such that the rotational energy of the fly wheel is transferred to kinetic energy of the tennis ball, resulting in acceleration of the ball and ejection through the ejection section 39 of the launching apparatus at a predefined angle and velocity.

Figure 8:
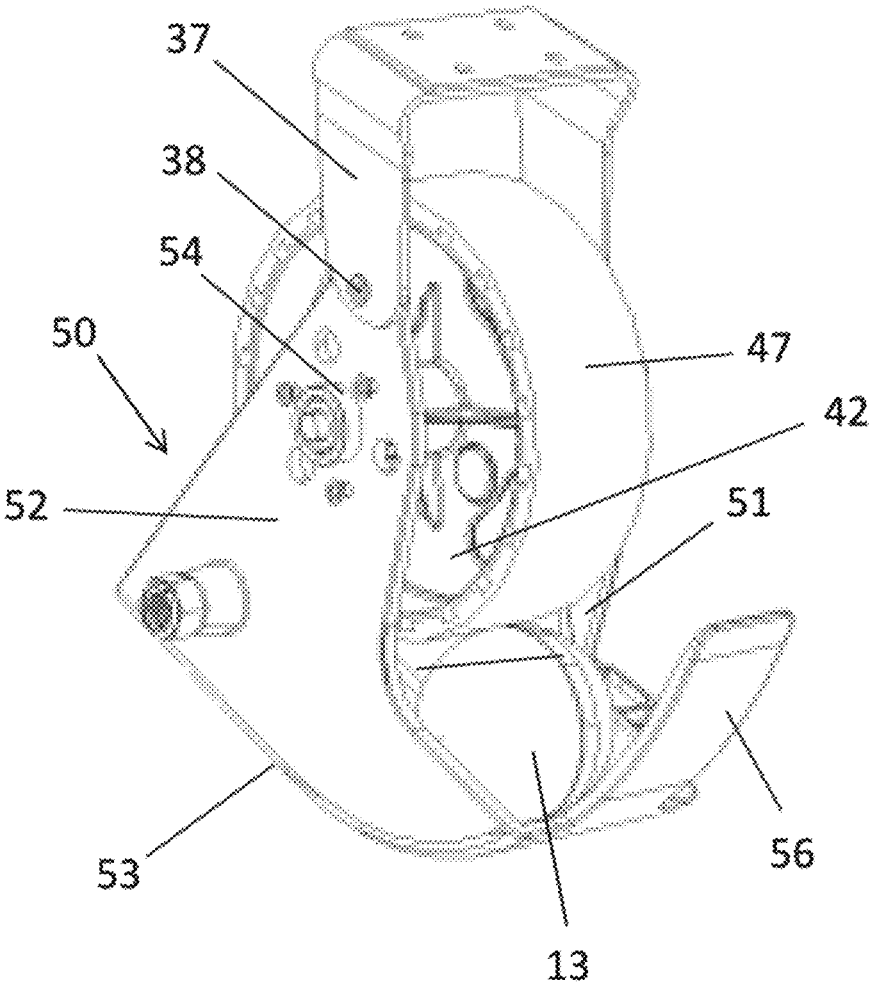
FIG. 8 is a side perspective view of a fly wheel mounting structure used in conjunction with the carrying bag of FIG. 6.

With reference to FIGS. 7 and 8, fly wheel 42 is rotatably mounted in a structure 50 having two identical, laterally spaced and vertically oriented mounting plates 51 and 52, and a lower guiding surface 53 interconnecting the two mounting plates. Flywheel motor 44 is mounted outwardly to mounting plate 51, and its drive shaft is stabilized by ball bearing member 54, which is mounted outwardly to mounting plate 52. Guiding surface 53 has a planar forward portion A from which a ball is ejected through ejection section 39 and opening 60, the latter also being shown in FIG. 6, and an arcuate rear portion B from which forward portion A tangentially extends and which narrows to a terminal portion 56 that passes through a lower opening 28 of chute 27 and into the chute interior, so as to be in close proximity with the back chute wall 29. Each of mounting plates 51 and 52 is wide at the bottom region thereof that coincides with guiding surface 53, and upwardly narrows to a region in which drive shaft 46 is rotatably mounted and then to the narrowest region at which it is pivotally connected via pin 38 with a U-shaped bracket 37 connected to horizontal mounting plate 22.

As shown in FIG. 8, fly wheel 42 while mounted to plates 51 and 52 may be separated from guiding surface 53 by a distance less than the diameter of ball 13. Thus when ball 13 is directed via the outlet of chute 27 to loading section 33, it will become compressed to a certain extent by fly wheel 42, reducing the air resistance of the ball when launched and increasing its speed until expanding in flight to the ball's normal dimensions.

It will be appreciated that fly wheel 42 may also be used in conjunction with barrel 303 of launching apparatus 206 illustrated in FIG. 3.

In other embodiments of the invention, the automatic launching apparatus may comprise a different launching apparatus, such as one that initiates ball ejection by means of air pressure.

FIG. 7 illustrates an embodiment of a mechanical launch angle adjusting mechanism 65. A bar 69 connected, e.g., threadedly connected, to a fixture 63 outwardly protruding from a forward portion of the bottom wide region of mounting plate 52 passes through a groove 67 formed in casing wall 64 of carrying bag 70, the groove shown to be arcuate, but which also may be oblique. The end of bar 69 is releasably connected, e.g., threadedly connected, to a knob 66. The angle of planar forward portion A of guiding surface 53 relative to the horizontal plane, for example ranging from 10-40 degrees, is set when knob 66 is secured to casing wall 64. When it is desired to adjust the angle of forward portion A, knob 66 is sufficiently loosened to allow displacement of bar 69 along groove 67. Displacement of bar 69 along groove 67 in turn initiates pivotal displacement of mounting plates 51 and 52 relative to bracket 37. Indicia 61 are provided at different positions along groove 67, to indicate the launching angle of the ball corresponding to the selected bar position.

Figure 12:
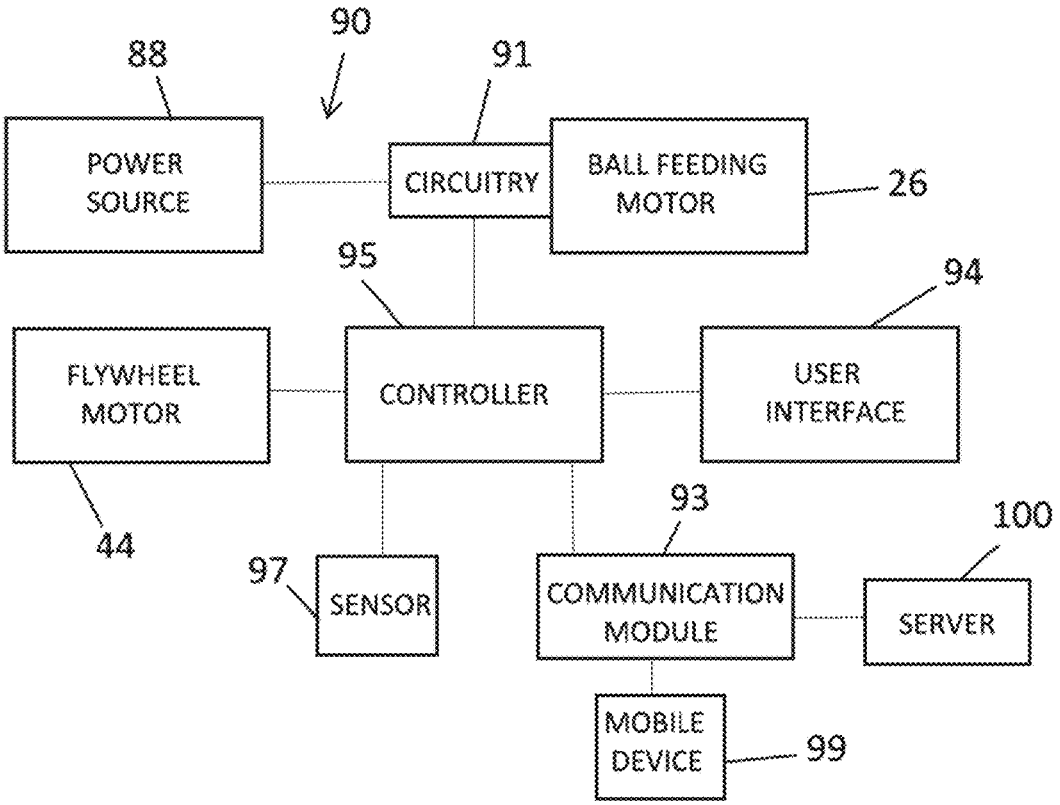
FIG. 12 is a schematic illustration of a control system used in conjunction with the carrying bag.

FIG. 12 schematically illustrates a control system 90 that is operable in conjunction with carrying bag 70 or 101. Control system 90 comprises controller 95, which is in data communication with each of ball feeding motor 26 and flywheel motor 44, and user interface 94 in data communication with controller 95 by which a user inputs desired operating conditions for ball feeding motor 26 and flywheel motor 44. Circuitry 91 of ball feeding motor 26, which is responsive to voltage and current characteristics of motor 26, transmits acquired motor data to controller 95.

Power source 88 is required to supply power to the various electrically powered components for a sufficient amount of time. Accordingly, a 3 amp-hour (Ah) 12 volt (V) battery may be used to power the launching apparatus and any other electrically powered components provided in various embodiments of the invention (e.g., an electronically controlled deflection member, sensors, processing elements, and a wireless communication module). An exemplary housing location of power source 88 is shown in FIG. 6.

Figure 13:
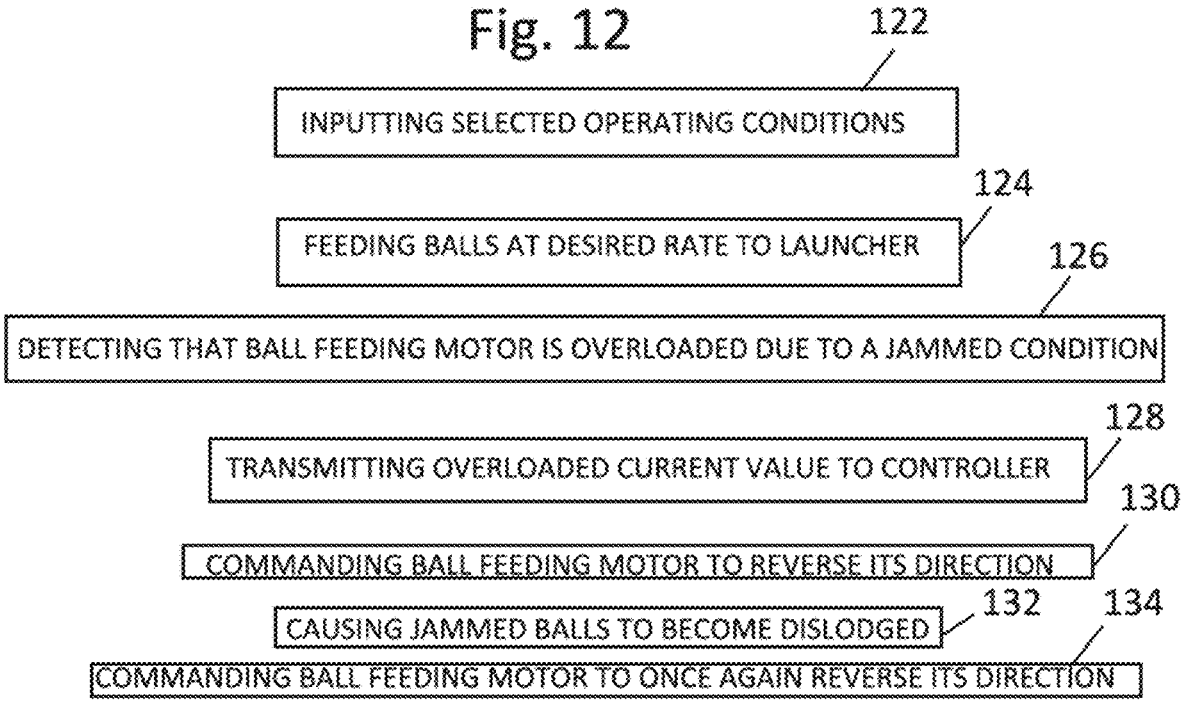
FIG. 13 is an anti-jamming method.

Control system 90 advantageously provides an anti-jamming function. As shown in FIG. 13, after the user inputs selected operating conditions such as by the user interface in step 122, balls are fed at a desired rate to the launcher in step 124 in response to commands issued by the controller while the ball receiving disc rotates in a first rotational direction and the ball feeding motor operates at the set voltage and current. If for some reason balls are not fed properly to the chute leading to the launching apparatus, for example when two balls are received simultaneously to the inlet port of the chute causing a jammed condition whereby additional balls are not able to be fed to the launching apparatus, the ball feeding motor becomes overloaded in step 126. The ball feeding motor circuitry detects that the motor is overloaded when it is operating with current that is higher than a predetermined value, for example a predetermined value that is proportional to the set current value or an absolute threshold, e.g., 1.7 amps, and transmits the detected overloaded current value to the controller in step 128. In response, the controller commands the ball feeding motor to reverse its operating direction in step 130 such that the ball receiving disc will rotate in a second rotational direction opposite to the first direction at substantially the same speed as in the first direction. Since the ball receiving disc is unloaded in the second rotational direction, the wall surrounding the through-hole region will urge at least one of the jammed balls to be dislodged from the chute inlet in step 132. The controller subsequently commands the ball feeding motor to once again reverse its operating direction in step 134 such that the ball receiving disc will rotate in the first rotational direction so that the launching cycle will be able to be completed.

According to an embodiment, control system 90 further comprises one or more sensors 97 in data communication with controller 95, which are attached for example to the inner shell or to the outer shell, and are configured to detect control commands given from afar. The sensors 97 may include sound sensors for detecting voice or sound commands (e.g., the sound of a racket hitting a tennis ball), visual sensors for visually detecting commands (e.g., a predefined hand gesture), and/or any other sensor suitable to detect a control command. Accordingly, controller 95 further comprises a processing element suitable to process data from the one or more sensors.

According to another embodiment, control system 90 further comprises a wireless communication module 93 configured to wirelessly communicate with an electronic computing device 99 (e.g., smartphone, PDA, tablet, etc.) and to receive commands therefrom, and to transmit training related data (e.g., a summary of a training session) that may be processed by a server 100. Electronic computing device 99 may be conveniently retained in mobile device compartment 41 (FIG. 10).

Below is an exemplary embodiment of a tennis-equipment carrying bag, the constructive details and constraints of which arise from the need to launch balls from one side of a tennis court to the other, and the need to withstand forces of ball launches. Obviously the specific values provided below are exemplary in nature and are provided for sake of demonstration. Obviously the present invention is not limited to these values and may be implemented with other values, without exceeding the scope of the claims.

One of the main considerations in the construction of a carrying bag according to the present invention is the manner in which a bag is kept in an upright position while launching balls and is prevented from falling over as result of a launch. Assuming that a launching apparatus (e.g., 206) comprises a fly wheel that turns at the speed of approximately 2500 revolutions per minute (rpm), and is configured to launch a tennis ball weighing less than 60 grams to a distance of at least 20 meters with an incline of 15-25 degrees above ground, the force exerted on the tennis ball would be between 250 and 300 Newtons (N). The distance $d_x$ between the front ejecting side of barrel 303 and the axle of wheels 206 is chosen so as to allow the bag to withstand the launching force, taking in account the horizontal component of the launch force $F_{Lx}$ and the weight of the bag that defines the amount of resistance force the wheels are able to withstand. For instance, the distanced $d_x$ may be 310 millimeters (mm) in a bag weighing 5 kilograms (kg) with a center of gravity located 351 mm above ground and 171 mm from the front side of the barrel.

Although embodiments of the invention have been described by way of illustration, it will be understood that the invention may be carried out with many variations, modifications, and adaptations, without exceeding the scope of the claims.

The invention claimed is:

1. A sport carrying bag, comprising:

a. a plurality of compartments suitable to accommodate sport equipment;

b. an automatic launching apparatus configured to launch balls to a distance from the sport carrying bag;

c. a hard outer shell external to the plurality of compartments;

d. an internal structure fastened to the outer shell which segments the sport carrying bag into the plurality of compartments and prevents the sport carrying bag from collapsing;

e. a ground contactable base configured to provide stability both when the sport carrying bag is stationary as well as while balls are being launched, f. a ball hopper compartment of the plurality of compartments, suitable to accommodate a plurality of the balls, with an opening in a bottom side of the ball hopper compartment;

g. an automatic launching apparatus compartment of the plurality of compartments accommodating the automatic launching apparatus; and h. a ball sorting apparatus for loading the balls to a loading section of the automatic launching apparatus in a controlled manner, wherein the automatic launching apparatus compartment and the ball sorting apparatus are held in place by the internal structure, wherein the automatic launching apparatus comprises the loading section and an ejection section, and wherein one of the balls is automatically delivered by the ball sorting apparatus from the bottom side opening of the ball hopper compartment to the loading section of the automatic launching apparatus and is automatically launched therefrom through the ejection section to a distance.

2. The sport carrying bag according to claim 1, wherein the automatic launching apparatus comprises an electrically rotatable fly wheel.

3. The sport carrying bag according to claim 1, further comprising a launch angle mechanism configured to determine a direction at which the balls are launched from the automatic launching apparatus.

4. The sport carrying bag according to claim 3, further comprising a control panel, suitable to control behavior of the automatic launching apparatus and of the ball sorting apparatus.

5. The sport carrying bag according to claim 4, wherein the launch angle mechanism is a deflection member electronically controlled by the control panel.

6. The sport carrying bag according to claim 5, further comprising one or more sensors configured to detect control commands given from afar.

7. The sport carrying bag according to claim 6, further comprising a wireless communication module configured to wirelessly communicate with an electronic computing device.

8. The sport carrying bag according to claim 4, wherein the ball sorting apparatus is settable to automatically deliver one of the balls from the ball hopper compartment to the loading section of the automatic launching apparatus once every fixed or unfixed time interval and at a desired launching velocity.

9. The sport carrying bag according to claim 1, further comprising wheels on opposite sides of the sport carrying bag and an extendable handle for carting the sport carrying bag.

10. The sport carrying bag according to claim 9, wherein a distance between the ejection section of the launching apparatus and an axle of the wheels is selected so as to allow the sport carrying bag to withstand a launching force, taking in account a horizontal component of said launching force and a weight of the sport carrying bag.

11. The sport carrying bag according to claim 10, which has a height greater than a width, and is kept in an upright position while launching the balls so as to be prevented from falling over as a result of the launch.

12. The sport carrying bag according to claim 1, further comprising:

an outer fabric that houses all of the compartments, protects internals from ingressions, and provides ergonomic means for handling the sport carrying bag.

13. The sport carrying bag according to claim 1, further comprising a retractable trolley type handle, allowing the sport carrying bag to be wheeled.

14. The sport carrying bag according to claim 1, further comprising at least one fabric strap or a shoulder strap by which the sport carrying bag is able to be carried and handled.

15. The sport carrying bag according to claim 1, wherein the base is a four contact point base.

16. The sport carrying bag according to claim 1, wherein the launching apparatus is configured to launch tennis balls from one side of a tennis court to another side of the tennis court.

17. The sport carrying bag according to claim 1, wherein the plurality of compartments includes a tennis racket compartment, suitable to accommodate one or more tennis rackets, in a removable secondary inner tennis bag.

18. The sport carrying bag according to claim 1, wherein the hopper compartment is integral with the outer shell and expandable, a side cover to the hopper compartment being securable to the outer shell in a closed condition to allow a first number of balls to be stored in the hopper compartment while being supported by a platform extending between opposed sidewalls of the outer shell and to fall from the platform onto the ball sorting apparatus, and also configured to be pivotally opened while remaining partially secured to the outer shell so as to be able to hold a second number of balls greater than the first number.

19. The sport carrying ball according to claim 1, which comprises automatic anti-jamming means.

20. The sport carrying bag according to claim 19, wherein the anti-jamming means comprises:

a. a disc of the ball sorting apparatus which is rotatable about a vertical axis and which is configured with a plurality of circumferentially spaced ball-receiving regions including one through-hole region, wherein said through-hole region is configured to receive a ball from the ball hopper compartment;

b. a mounting plate located below said disc;

c. a chute downwardly extending to the loading section of the automatic launching apparatus;

d. a fixed bi-directional ball feeding motor, for rotatably driving said disc; and e. a controller in data communication with said ball feeding motor, wherein circuitry of said ball feeding motor is suitable to transmit acquired motor data to said controller, wherein, upon rotation of said disc in a first rotational direction, said ball received in said through-hole region ceases to be contacted by said mounting plate at one angular position of said disc coinciding with said chute and gravitates through said chute to the loading section of the automatic launching apparatus, wherein, in response to a detected jammed condition whereby additional balls are unable to be fed from said disc to said launching apparatus, said circuitry detects that said ball feeding motor is overloaded and said controller commands said ball feeding motor to reverse its operating direction such that said disc will rotate in a second rotational direction opposite to the first direction to cause one or more jammed balls to become dislodged.

* * * * *